US011147325B2

(12) United States Patent
Collier

(10) Patent No.: US 11,147,325 B2
(45) Date of Patent: Oct. 19, 2021

(54) SONIC EXFOLIATING GLOVE

(71) Applicant: Michael Andrew Collier, Glendale, AZ (US)

(72) Inventor: Michael Andrew Collier, Glendale, AZ (US)

( * ) Notice: Subject to any disclaimer, the term of this patent is extended or adjusted under 35 U.S.C. 154(b) by 176 days.

(21) Appl. No.: 16/181,030

(22) Filed: Nov. 5, 2018

(65) Prior Publication Data

US 2020/0138128 A1 May 7, 2020

(51) Int. Cl.
*A41D 19/00* (2006.01)
*A45D 19/00* (2006.01)
*A41D 1/00* (2018.01)

(52) U.S. Cl.
CPC ..... *A41D 19/0024* (2013.01); *A41D 1/002* (2013.01); *A41D 19/0044* (2013.01); *A45D 19/00* (2013.01); *A45D 2200/207* (2013.01)

(58) Field of Classification Search
CPC ..... A41D 19/0024; A41D 1/002; A41D 19/0044; A47L 13/18; A47L 13/19; A46B 5/04; A45D 19/00; A45D 2200/207; A47K 7/02
USPC ..... 2/160
See application file for complete search history.

(56) References Cited

U.S. PATENT DOCUMENTS 1,161,719 A * 11/1915 Norton ..... 601/154
4,577,625 A * 3/1986 Lohati ..... A61H 15/0092 601/128
5,601,529 A * 2/1997 Wollman ..... A61H 23/0263 601/70
6,401,252 B1 * 6/2002 Dean ..... A61H 7/005 2/160
6,604,244 B1 * 8/2003 Leach ..... A41D 19/0055 15/227
6,646,855 B2 * 11/2003 Buening ..... F41H 13/0018 2/160
7,707,654 B1 * 5/2010 Spence ..... A61H 7/003 2/161.6
9,775,769 B2 * 10/2017 Brown ..... A61F 13/104
10,383,378 B1 * 8/2019 Ptah ..... A61H 7/007
10,799,417 B1 * 10/2020 Carr ..... A61H 7/001
2003/0221238 A1 * 12/2003 Duboff ..... A41D 19/00 2/160

(Continued)

FOREIGN PATENT DOCUMENTS

WO WO-2011148855 A1 * 12/2011 ..... A61H 37/00

*Primary Examiner* — Alissa L Hoey
(74) *Attorney, Agent, or Firm* — Parsons & Goltry; Roberts Parsons; Michael Goltry

(57) ABSTRACT

A sonic exfoliating glove includes a glove shaped member having a hand receiving portion with a hand receiving opening therein, four finger receiving portions, and a thumb receiving portion, the glove shaped member defining a palm surface overlying a palm and finger and thumb pads of a hand inserted therein. Five of six exfoliating pads are fixedly attached to the four finger receiving portions and the thumb receiving portion, one each, generally overlying the finger and thumb pads of the respective finger or thumb. A sixth exfoliating element is fixedly attached to the glove shaped member, so as to overly a central portion of the palm. At least one vibrating motor is attached to the glove shaped member and six connecting rods are each connected at one end to the at least one vibrating motor and at another end to the six exfoliating pads or elements, one each.

1 Claim, 2 Drawing Sheets

(56) References Cited

U.S. PATENT DOCUMENTS

| | | | | |
|---|---|---|---|---|
| 2004/0087881 | A1* | 5/2004 | Gross | A61H 7/001 601/15 |
| 2005/0034211 | A1* | 2/2005 | Yen | A01K 13/001 2/159 |
| 2005/0143679 | A1* | 6/2005 | Gelber | A61H 7/005 601/15 |
| 2006/0272116 | A1* | 12/2006 | Thompson | A47L 13/18 15/227 |
| 2008/0041319 | A1* | 2/2008 | Rasmussen | A01K 13/001 119/603 |
| 2008/0087296 | A1* | 4/2008 | Gueret | A46B 5/0095 132/317 |
| 2008/0216207 | A1* | 9/2008 | Tsai | A61H 23/0263 2/160 |
| 2008/0244848 | A1* | 10/2008 | Firouzman | A47L 13/12 15/118 |
| 2011/0004974 | A1* | 1/2011 | Firouzman | A47L 13/18 2/161.8 |
| 2012/0136288 | A1* | 5/2012 | Napier | A61H 23/0263 601/48 |
| 2012/0160257 | A1* | 6/2012 | Jenkins | A47K 7/02 132/200 |
| 2013/0035650 | A1* | 2/2013 | Wang | A61K 8/0204 604/292 |
| 2014/0066925 | A1* | 3/2014 | Howard | A61H 23/00 606/38 |
| 2016/0113834 | A1* | 4/2016 | Bring | A61H 7/007 601/134 |
| 2016/0317841 | A1* | 11/2016 | Nathanson | A61N 7/00 |
| 2017/0142931 | A1* | 5/2017 | Michaelson | B29C 45/1701 |
| 2018/0311570 | A1* | 11/2018 | Buchanan | G06F 3/0346 |
| 2019/0328107 | A1* | 10/2019 | Brown | A45D 34/04 |

* cited by examiner

SONIC EXFOLIATING GLOVE

FIELD OF THE INVENTION

This invention relates to sonically activated exfoliating gloves and more specifically to gloves for use in exfoliating procedures.

BACKGROUND OF THE INVENTION

In exfoliating procedures, dead cells, flakes, or layers of skin are removed from the outer surface of the skin. Exfoliating is well known, possibly started by ancient Greeks, and currently involves chemical or mechanical procedures. Mechanical exfoliating generally includes scrubbing the skin surface with an abrasive material (e.g. microfiber cloths, brushes, pumice, grainy material such as sugar, salt, etc.) Generally, the various procedures are performed manually by a professional but some exfoliating can be performed by the individuals themselves.

Several problems are prevalent in current exfoliating procedures. Primary problems include cleanliness for health reasons, damage caused to the skin being exfoliated, time expended and the cost which can be quite high if the exfoliating is performed by a professional and is performed periodically. Another problem is that the exfoliating is always performed manually and generally includes some human judgement as to the length of scrubbing time required and/or the length of time actually used in any specific area. Human judgement as to the scrubbing time actually performed can be very nebulous. Also, depending upon the abrasive material used, the amount of exfoliating that occurs can vary as the abrasiveness varies.

Scalp exfoliating procedures are used to promote hair growth, or to at least retard hair loss. This procedure is typically accomplished by a hair care specialist using fingertips and fingernails to reach through the hair, to directly contact the scalp. Finger nail use removes dead skin cells and helps unclog hair follicles to promote hair growth and retard hair loss. While this procedure has been found to be effective, maintaining clean fingernails and preventing damage to the client scalp is problematic. Inadvertent scratches and dirty fingernails can result in infections and the like. Thus, while somewhat effective, the detriments can outweigh the benefits It would be highly advantageous, therefore, to remedy these and other deficiencies inherent in the prior art.

Accordingly, it is an object of the present invention to provide a new and improved sonic exfoliating glove.

It is another object of the present invention to provide a new and improved sonic exfoliating glove that reduces skin damage and is easier to use.

SUMMARY OF THE INVENTION

Briefly, to achieve the desired objects of the instant invention in accordance with a preferred embodiment thereof, a sonic exfoliating glove is provided that includes a glove shaped member having a hand receiving portion with a hand receiving opening therein, four finger receiving portions, and a thumb receiving portion, the glove shaped member defining a palm surface overlying a palm and finger and thumb pads of a hand inserted therein. Five of six exfoliating pads are fixedly attached to the four finger receiving portions and the thumb receiving portion, one each, generally overlying the finger and thumb pads of the respective finger or thumb. A sixth exfoliating element is fixedly attached to the glove shaped member, so as to overly a central portion of the palm. At least one vibrating motor is attached to the glove shaped member and six connecting rods are each connected at one end to the at least one vibrating motor and at another end to the six exfoliating pads or elements, one each.

The desired objects of the instant invention are further achieved in accordance with specific embodiment of a sonic exfoliating glove including a main body or glove shaped member having a hand receiving portion with a hand receiving opening therein, four finger receiving portions, and a thumb receiving portion, the main body or glove shaped member defining a palm surface overlying a palm and finger and thumb pads of a hand inserted therein. The sonic exfoliating glove further includes six exfoliating pads or elements fixedly attached to the palm surface, five of the six exfoliating pads or elements fixedly attached to the four finger receiving portions and the thumb receiving portion, one each, adjacent an end of the associated portion and generally overlying the finger and thumb pads of the respective finger or thumb, a sixth exfoliating element fixedly attached approximately centrally to the main body or glove shaped member, so as to overly a central portion of the palm, and the six exfoliating pads or elements being rigid with an abrasive outer surface, a wrist band attached to the hand receiving opening of the main body or glove shaped member coaxial with the hand receiving opening, the wrist band being sufficiently rigid to allow substantially all movement of the six electric vibrating motors to be transferred to the six exfoliating pads or elements, six electric vibrating motors mounted on the wrist band, the six electric vibrating motors are energizable to vibrate at a sonic rate, and six connecting rods or elements connected at one end to the six electric vibrating motors, one each, and at another end to the six exfoliating pads or elements, one each.

The desired objects of the instant invention are further achieved in accordance with a method of fabricating a sonic exfoliating glove including the step of providing a main body or glove shaped member, the glove shaped member having a hand receiving portion with a hand receiving opening therein, four finger receiving portions, and a thumb receiving portion, and the glove shaped member defining a palm surface overlying a palm and finger and thumb pads of a hand inserted therein. The steps of providing six exfoliating pads or elements and fixedly attaching the six exfoliating pads or elements to the palm surface of the glove shaped member so that five of the six exfoliating pads or elements are fixedly attached to the four finger receiving portions and the thumb receiving portion, one each, adjacent an end of the associated portion and generally overlying the finger and thumb pads of the respective finger or thumb, and a sixth exfoliating element is fixedly attached approximately centrally to the main body or glove shaped member, so as to overly a central portion of the palm. The steps of providing at least one vibrating motor and fixedly mounting the at least one vibrating motor on the main body or glove shaped member. The method further includes the steps of providing six connecting rods or elements and connecting the six connecting rods or elements at one end to the at least one vibrating motor and at another end to the six exfoliating pads or elements, one each, whereby vibration of the at least one vibrating motor is transmitted to the six exfoliating pads or elements.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
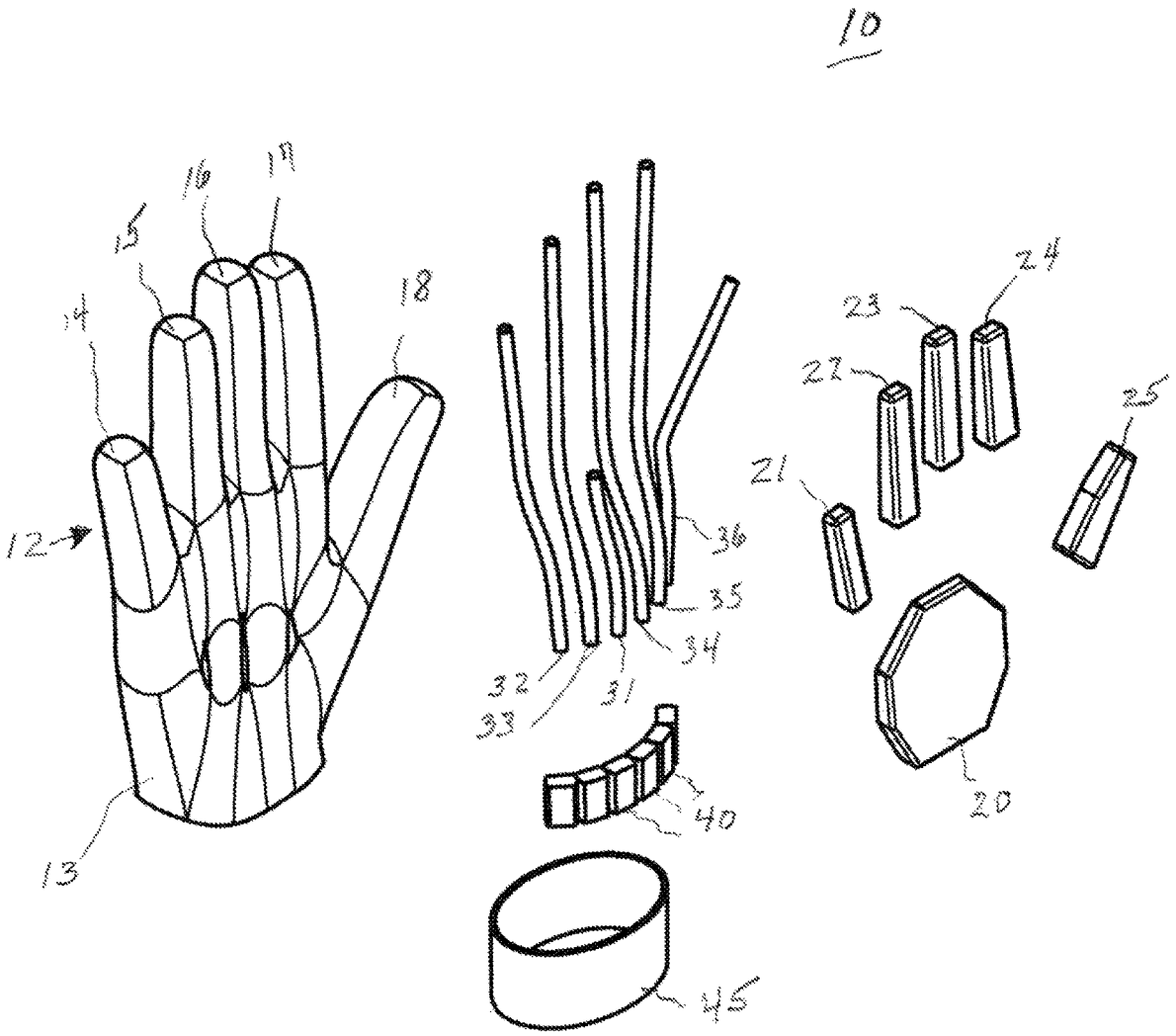
FIG. 1 is an exploded view of a sonic exfoliating glove, illustrating the various components, in accordance with the present invention.

Turning to the drawings and specifically to FIG. 1, the various components of a sonic exfoliating glove 10 are illustrated. Glove 10 is formed to receive a human hand (operator's hand) in a normal encasing or enclosing orientation. To this end, glove 10 includes a main body or glove shaped member 12 which has a hand receiving portion 13, four finger receiving portions 14-17, and a thumb receiving portion 18. Glove shaped member 12 and portions 14-18 can be constructed of a relatively stiff material (e.g. a stiff plastic) with joints formed at critical junctures to allow closing movement or it can be constructed of normal glove material (e.g. cloth, leather, plastic, etc.}. As will be understood from the description below, the stiffer material will produce a more coordinated or uniform overall pressure during exfoliating procedures whereas the normal glove materials (more flexible materials) allows for more conformity to the shape of the area being treated, such as curved for the scalp, but also requires the operator to use more finger movement to produce the same results.

Sonic exfoliating glove 10 further includes six exfoliating pads or elements 20-25, five (21-24) to attach to the fingers and thumb, and one (20) to overly a portion of the palm). Sonic exfoliating glove 10 further includes six connecting rods or elements 31-36, six electric vibrating motors, each designated 40, and a wrist band 45.

Figure 2:
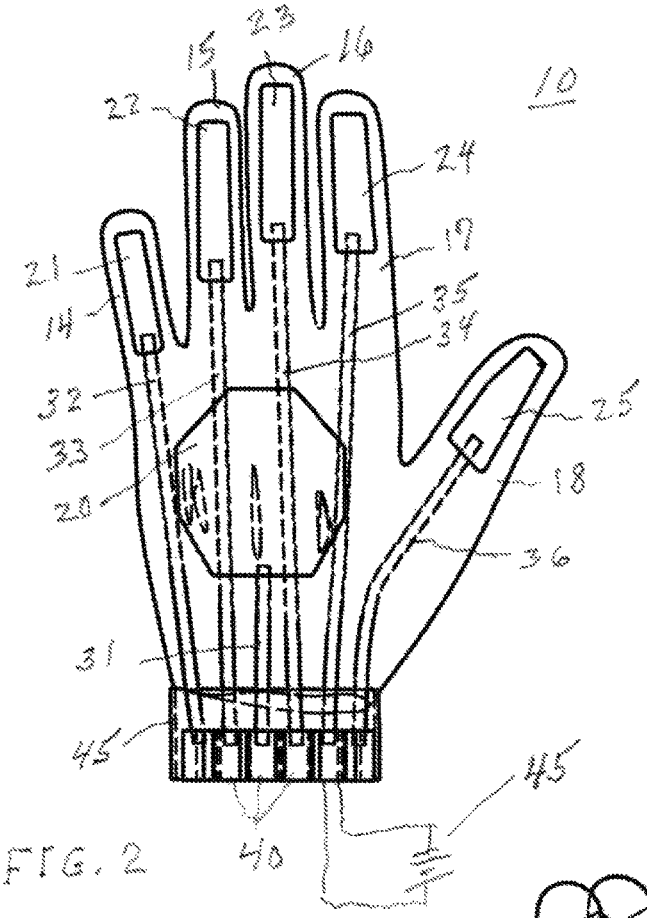
FIG. 2 is a plan view of the palm or working side of sonic exfoliating glove of FIG. 1.
Figure 3:
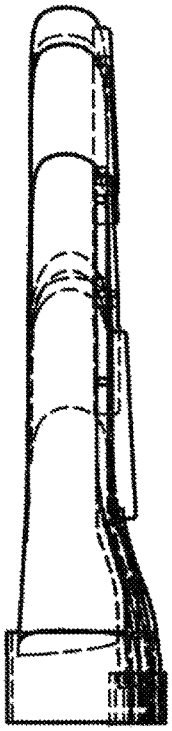
FIG. 3 is a side view of the sonic exfoliating glove of FIG. 1.
Figure 4:
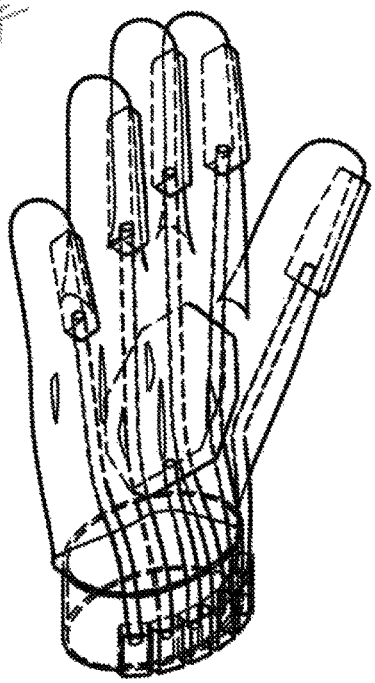
FIG. 4 is a palm or working side view in perspective of the sonic exfoliating glove of FIG. 1.

Turning to FIGS. 2-4, it can be seen that five of the six exfoliating pads or elements 20-25 are fixedly attached to the four finger receiving portions 14-17 and thumb receiving portion 18, one each respectively. Each of the exfoliating pads or elements 20-25 is connected adjacent the end of the associated portion and generally over the pad of the respective finger or thumb. The sixth exfoliating element, 20, is fixedly attached approximately centrally to the main body or glove shaped member 12, so as to overly a central portion of the palm.

Wrist band 45 is affixed coaxially around the hand receiving opening in the main body or glove shaped member 12 and, depending upon the material of the main body or glove shaped member 12 could simply be an extension thereof. For purposes of this disclosure wrist band 45 will be considered a separate component which is constructed of material sufficiently stiff or ridged to mount the six electric vibrating motors 40. The six connecting rods or elements 31-36 are fixedly connected between the six electric vibrating motors 40 and the six exfoliating pads or elements 20-25. That is, rod 31 connects one of the electric vibrating motors 40 to exfoliating pad or element 20, rod 32 connects one of the electric vibrating motors 40 to exfoliating pad or element 21, rod 33 connects one of the electric vibrating motors 40 to exfoliating pad or element 22, rod 34 connects one of the electric vibrating motors 40 to exfoliating pad or element 23, rod 35 connects one of the electric vibrating motors 40 to exfoliating pad or element 24, and rod 36 connects one of the electric vibrating motors 40 to exfoliating pad or element 25.

Here it should be understood that six vibrating electric motors are described as a preference, because they are inexpensive and easy to connect, but in some specific applications it may be convenient to use a single vibrating motor physically attached to all of the six exfoliating pads or elements. Also, while the motor or motors are preferably electric (because of the convenience of providing electrical power, e.g. batteries, etc.) it might be possible in some applications to energize the motor or motors with pressurized fluid or gas. Thus, it should be understood that it is a primary objective of this invention to vibrate the six exfoliating pads or elements at a sonic rate so as to achieve the various advantages described above.

Electric vibrating motors 40 can be either battery operated or connected by an electric line (designated 45 and only one connection illustrated for convenience). Motors 40, through connecting rods or elements 31-36, cause the six exfoliating pads or elements 20-25 to vibrate at a rate generally in the sonic range, which could be for example 20 Hz to 20,000 Hz. In operation, the operator/user of sonic exfoliating glove 10 presses the six exfoliating pads gently against the surface of the skin being exfoliated and moves glove 10 gently over the skin. It is believed that the sonic vibration of each of the six exfoliating pads causes not only a scrubbing action on the surface of the skin but also create a secondary cleansing action caused by air turbulence between the exfoliating pads and the skin surface, which is produced by the high rate of movement of the exfoliating pads. A main idea here is that the vibrating motion of the exfoliating pads produce a scrubbing and sonic cleaning action that quickly and easily removes foreign materials and dead skin cells from the skin with very little manual scrubbing and very little effort on the part of the operator/user. Because very little actual physical scrubbing is required, a minimum amount of damage is inflicted on the skin surface. Further, because of the ease of operation. Professional exfoliaters are not required and glove 10 can actually be operated by the person being exfoliated.

In a specific embodiment, the six exfoliating pads are formed of a rigid material with an abrasive outer surface (facing away from the palm surface of the glove). An example of a rigid abrasive surface might be a thin strip of pumice, microfiber cloth on a plastic strip, or the like. The six connecting rods or elements are sufficiently rigid to transmit vibrations or vibrating movements from the electric motors to the rigid exfoliating pads. Further, the wrist band is sufficiently rigid to mount the electric motors so that vibrations or vibrating movements of the electric motors are substantially transmitted to the rigid exfoliating pads. In another specific embodiment, the six exfoliating pads are formed of bristles to extend through hair, such as when exfoliating an individual's scalp In a preferred method of exfoliating, an operator/user places their hand in sonic exfoliating glove 10 and energizes or activates motors 40, either by attaching battery (possibly mounted on the back side of sonic exfoliating glove 10) or otherwise attaching to an electric source 45. The operator/user then places their hand on the skin surface to be exfoliated and gently moves the glove over a designated surface. No manual, physical scrubbing is required. The operator/user simply moves the glove slowly over the surface with a minimum of pressure and can repeat the process as deemed necessary after an inspection of the skin. The shape of exfoliating glove can conform to the surface being exfoliated simply by altering the palm and fingers of the hand wearing the exfoliating glove to match the contours of the surface being exfoliated.

Thus, the present invention provides a new and improved sonic exfoliating glove. The new and improved sonic exfoliating glove reduces skin damage because aggressive physical scrubbing is not required. Further, because the new and improved sonic exfoliating glove produces all of the scrubbing action automatically, it is easier to use, not requiring professional exfoliaters.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A sonic exfoliating glove comprising:

a main body or glove shaped member having a hand receiving portion with a hand receiving opening therein, four finger receiving portions, and a thumb receiving portion, the main body or glove shaped member defining a palm surface for overlying a palm and finger and thumb pads of a hand inserted therein;

six exfoliating pads fixedly attached to the palm surface, five of the six exfoliating pads fixedly attached to the four finger receiving portions and the thumb receiving portion, one each, a sixth exfoliating pad fixedly attached to the hand receiving portion and the six exfoliating pads having an outer surface, the outer surface carrying one of an abrasive layer and bristles;

a wrist band attached to the hand receiving opening of the main body or glove shaped member coaxial with the hand receiving opening;

six electric vibrating motors mounted on the wrist band, the six electric vibrating motors are energizable to vibrate at a sonic rate; and six connecting rods or elements connected at one end to the six electric vibrating motors, one each, and at another end to the six exfoliating pads, one each.

* * * * *